US009681715B2

(12) United States Patent
Brandt

(10) Patent No.: US 9,681,715 B2
(45) Date of Patent: Jun. 20, 2017

(54) SLENDER AND COMFORTABLE WALLET FOR ENHANCED FOLDING MONEY AND CREDIT/IDENTIFICATION CARD CARRYING

(76) Inventor: Richard F. Brandt, Shrewsbury, NJ (US)

( * ) Notice: Subject to any disclaimer, the term of this patent is extended or adjusted under 35 U.S.C. 154(b) by 975 days.

(21) Appl. No.: 13/374,680

(22) Filed: Jan. 9, 2012

(65) Prior Publication Data

US 2013/0174950 A1 Jul. 11, 2013

(51) Int. Cl.
*A45C 1/06* (2006.01)

(52) U.S. Cl.
CPC ..... *A45C 1/06* (2013.01)

(58) Field of Classification Search
CPC .. A24F 15/18; A45C 1/00; A45C 1/06; A45C 1/08; A45C 11/182
USPC ..... 150/131, 132, 139, 136, 143, 140, 147; 206/232, 438; 224/222; D3/247, 250
See application file for complete search history.

(56) References Cited

U.S. PATENT DOCUMENTS 2,249,558 A * 7/1941 Green ..... A45C 1/06 150/140
2,300,144 A * 10/1942 Buxton ..... A45C 1/06 150/138
2,368,040 A * 1/1945 Pitar ..... A45C 1/06 150/139
2,592,918 A * 4/1952 Loncich ..... A45C 1/06 150/139
2,612,201 A * 9/1952 Lipp ..... A45C 1/06 150/133
2,732,875 A * 1/1956 Martin ..... A45C 1/06 150/147
3,120,253 A * 2/1964 St Thomas ..... A45C 1/08 150/136
3,165,135 A * 1/1965 Mintzes ..... A45C 1/06 150/133
3,946,781 A * 3/1976 Reis ..... A45C 1/06 150/143
4,105,057 A * 8/1978 Baumann ..... A45C 1/06 150/132
4,209,048 A * 6/1980 Sandos ..... A45C 1/06 150/132
4,905,881 A * 3/1990 Graber ..... A45C 1/04 150/131
6,065,515 A * 5/2000 Harris ..... A45C 1/06 150/132
6,471,127 B2 * 10/2002 Pentz ..... G06K 13/063 235/487
8,328,106 B1 * 12/2012 Trujillo ..... G06K 19/041 235/449

(Continued)

*Primary Examiner* — Fenn C Mathew
*Assistant Examiner* — Cynthia Collado
(74) *Attorney, Agent, or Firm* — Meagher Emanuel Laks Goldberg & Liao, LLP

(57) ABSTRACT

A wallet for retaining a plurality of rectangularly configured credit, business and identification cards along with currency bills includes a case and a fabric partition dividing the wallet and cards into upper and lower sections with the cards being inserted within the sections with their larger sides parallel to the top and bottom edges of the case and perpendicular to its side edges, and with the case adapted for insertion via either section, top or bottom edge first, downwardly into a back pocket of a wearer's trousers, a purse or pocketbook without folding over.

7 Claims, 4 Drawing Sheets

(56) References Cited

U.S. PATENT DOCUMENTS

2013/0014867 A1* 1/2013 Newingham ..... A45C 1/06
150/147

* cited by examiner

SLENDER AND COMFORTABLE WALLET FOR ENHANCED FOLDING MONEY AND CREDIT/IDENTIFICATION CARD CARRYING

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

Field of the Invention

This invention relates to back pocket-carried wallets, in general, and to a new and improved slender and comfortable wallet configuration to reduce the bulging otherwise presented in such wallets holding currency bills, credit, and business and identification cards carried about in the pockets of a wearer's trousers. As will be appreciated by those skilled in the art, the slender presentation of such a wallet would be desirable if the wallet were merely carried in a purse or pocketbook even though there, the unsightly condition might not be such a sartorial problem—let alone one which hampers a user having to squirm about when sitting due to the thickness and breadth of those wallets which presently characterize the prior art.

Description of the Related Art

Wallets which retain multitudes of credit, and business and identification cards (as well as driver's licenses, health insurance cards, library cards, photographs, and currency bills) have been around for years. And, as will be appreciated, some of these carried cards are referred to, and used, more frequently than others—it not being uncommon to have situations where many of the cards are not really needed. Yet, while resort is oftentimes more to be had for one, two or three different credit cards, and perhaps for a driver's license, others' business cards and like items are just inserted and kept out of habit—and then, only cleared out when changing to a new wallet or when one is going on vacation and realizes that almost all of the business cards and like inclusions are not really needed for the trip being taken. Nevertheless, it is not unusual to find in a folded over wallet, 10, 15, and 20 cards of one form or fashion being carried about on a daily basis ready to be used if the occasion arises. Any male (or female for that matter) wearing trousers into a back pocket of which the wallet is inserted, experiences a not insignificant discomfort when having to adjust one ways or another while sitting in a car, bus, train or airplane because of the wallets size and weight.

The significance of this will be understood all the more when considering the typical construction of today's wallet—in which, when opened, the credit, business and identification cards are arranged horizontally one behind the other in left and right halves, and in sections vertically separated one from another in each half by a fabric or leather lining in arranging the cards in a stacked fashion. With each section, with their own fabric or leather lining holding their cards in place, the folding of one half of the wallet over the other half becomes all the more difficult because of the added thickness and the discomfort that results when trying to sit with it in one's back pants pocket. This becomes even more so when one gets to the additional linings in back which separate the currency bills or folding money in the wallet from the cards carried in front. The overall layout of the wallet then becomes primarily a horizontal, left-to-right one, in which one half-section with its cards is folded over the opposite half-section with its own cards, essentially folding in half whatever paper-money currency bills are being carried. The result is an uncomfortable sitting experience with the folded-over wallet in the back pocket.

OBJECTS OF THE PRESENT INVENTION

It is an object of the present invention, therefore, to provide a new and improved construction for a wallet which is slenderizing and of a thinner profile, and all the while more comfortable to be carried in the pockets of a wearer's trousers.

It is an object of the invention, also, to provide such a thin profile wallet construction of a nature to reduce the number of those unnecessary separating liners which characterize wallet constructions typically found in present day usage.

It is another object of the invention to provide a construction which, of necessity, allows for the carrying of many rarely used credit, business and identification cards, cards of others, as well as accentuating the carrying of one's most used own credit and identification cards and folding money currency.

SUMMARY OF THE INVENTION

Recognizing that certain credit cards and identification cards are used more frequently than others, the present invention provides a thin profile wallet without the unnecessary manners of employing stacked liners of increasing dimension to separate different sections of individual cards one from another.

Thus, in accordance with the invention, a wallet for retaining a plurality of credit and business identification cards along with currency bills includes a rectangularly configured case having a fabric partition insert running between the side edges of the case in forming upper and lower sections of the case. The wallet also includes a plurality of rectangularly shaped credit, business and identification cards with their longer sides running parallel to the top and bottom edges of the case, and perpendicular to the side edges of the case, one behind the other within the case on either side of the fabric partition. A fabric liner insert is additionally provided between the credit and business identification cards on the one hand and an inside wall of the case on the other hand, in forming a section between the liner and the inside wall capable of receiving currency bills. Lastly, the wallet includes means for temporarily securing the case closed at either of its side edges.

In use, the case is inserted into a back trouser pocket, purse or pocketbook top or bottom edge first downwardly, without any folding over as characterized by the prior art.

As will also be seen, the case in a preferred embodiment of the invention is of a leather or fabric outer composition—and in accordance with the primary objective of the invention, is sized to fit within the back pocket of a wearer's trousers. A two-component fastening system is used to temporarily secure the case closed, as can be provided, for example, by a standard hook-and-loop Velcro adhesive arrangement or by a zip-lock connection, or zipper, or flap.

BRIEF DESCRIPTION OF THE DRAWINGS

These and other features of the invention will be more clearly understood from a consideration of the following description, taken in connection with the accompanying drawings, in which.

DETAILED DESCRIPTION OF THE INVENTION

Figure 1:
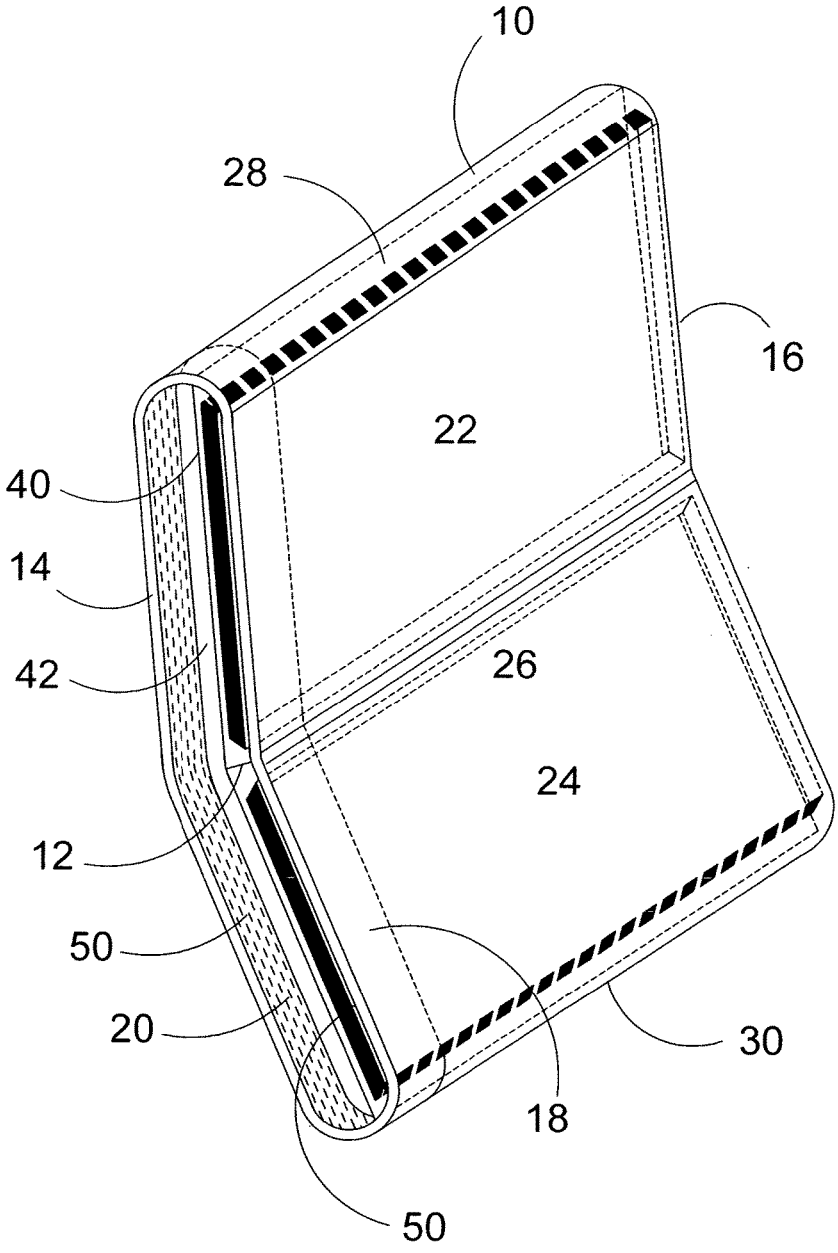
FIG. 1 is an illustration of a preferred embodiment of the case of the invention ready for insertion into a back trouser pocket, a purse or a pocketbook according to the invention.
Figure 2:
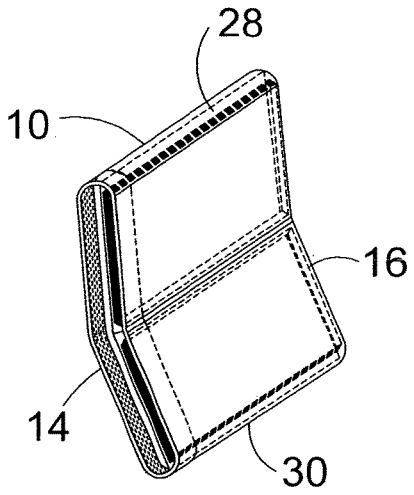
FIGS. 2, 3, 4, and 5 are pictorial illustrations helpful in understanding the orientation of the case when inserted into a back trouser pocket, top or bottom edge first downwardly.
Figure 3:
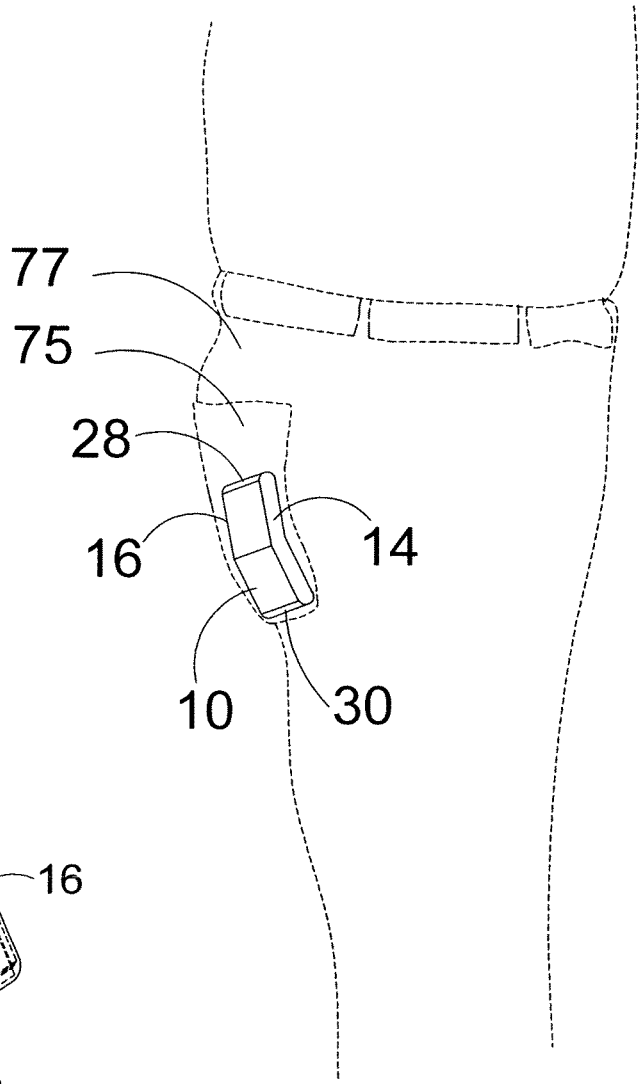
Figure 4:
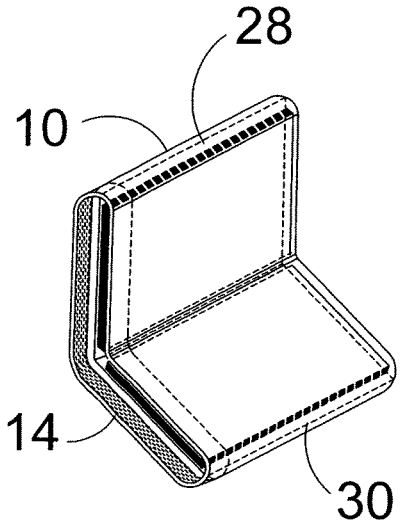
Figure 5:
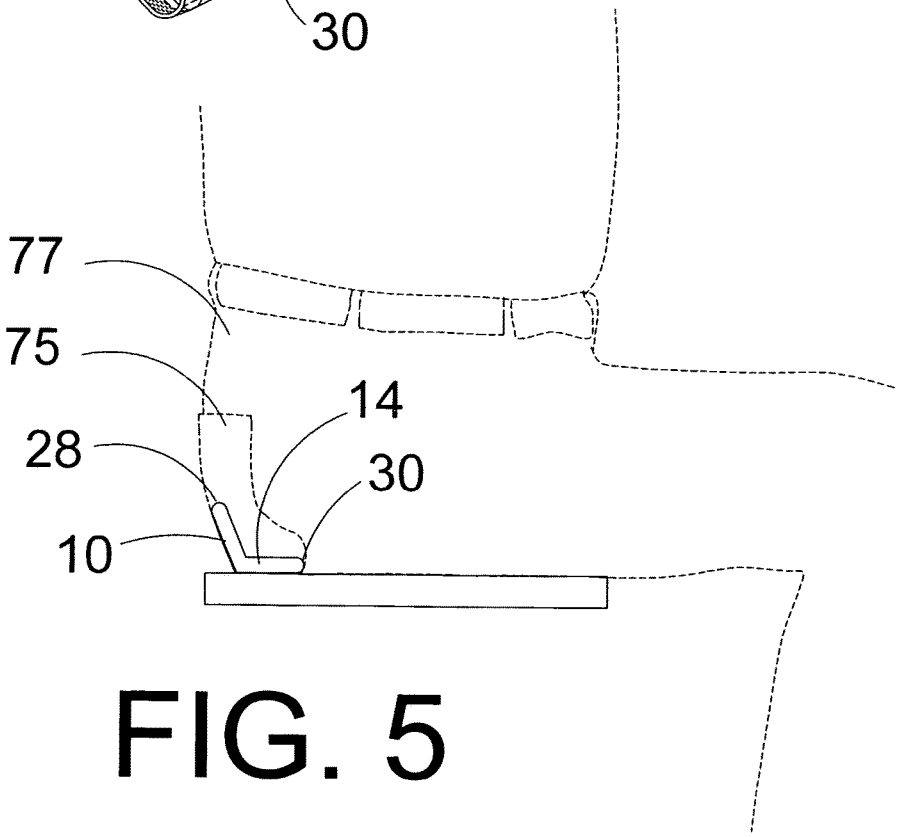

FIGS. 1, 2, 3, 4 and 5 show the case 10 of the invention as being tilted at an angle only for purposes of ease of understanding, it being appreciated that when constructed and ready for insertion into a back trouser pocket, a purse or a pocketbook, the case 10 and the wallet lie substantially flat. As illustrated, the case 10 is rectangularly configured having a fabric partition insert 12 running between the side edges 14, 16 of the case 10 in forming upper and lower sections 18, 20. A plurality of rectangularly shaped credit, business and identification cards 22, 24 are included in the sections 18, 20, with their longer sides 26, running parallel to the top and bottom edges of the case 28, 30 and perpendicular to the side edges 14, 16. As shown, the cards are arranged in stacked fashion one behind the other, within the case on either side of the fabric partition 12. A fabric liner 40 is included between the credit and business identification cards on the one hand and an inside wall of the case 10 on the other hand in forming a section capable of receiving currency bills 42. With the case 10 having its outer surfaces of a leather or fabric composition, the wallet formed by the case of FIGS. 1, 2 and 4 is sized to fit within a back pocket 75 of a wearer's trousers 77 as illustrated in FIGS. 3 and 5.

Figure 6:
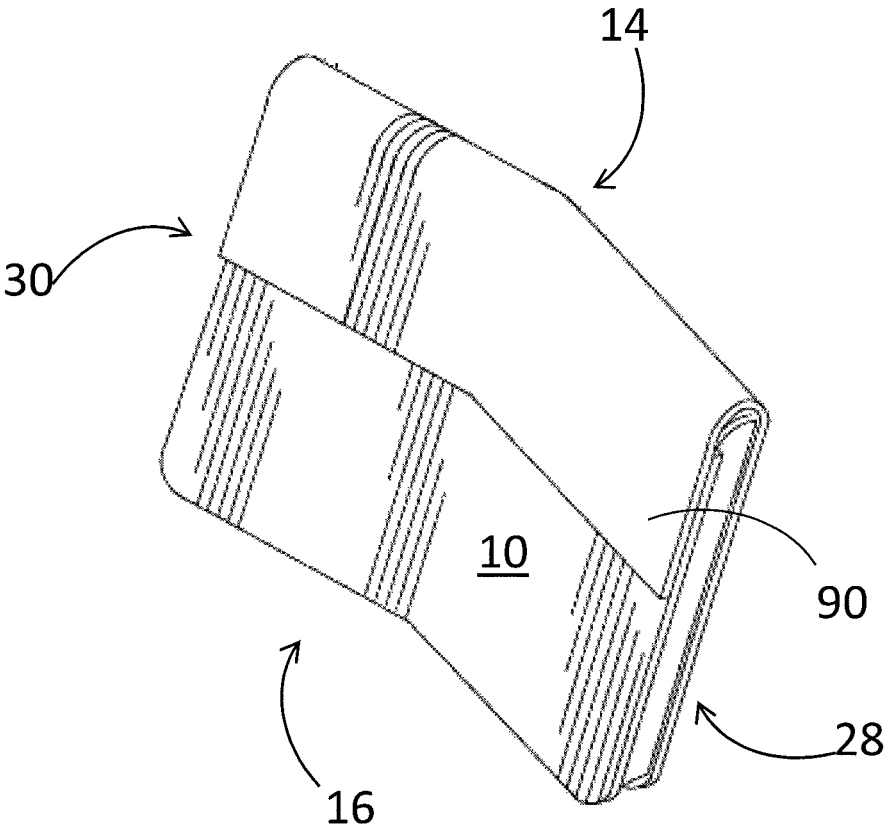
FIG. 6 is an illustration of an embodiment of the case of the invention including a folded over flap material for closing the case.

As is also illustrated in FIG. 1, the wallet case 10 may include a two component fastener arrangement at the side edges 14 of the upper and lower sections 18 and 20 for securing the case closed when outside the pocket, purse or pocketbook. In FIG. 1, the two component fastener includes a standard zip-lock connector 50 on the front and rear surfaces of the case —while in FIG. 4, a hook-and-loop adhesive is employed, or a zipper can be inserted or a flap material may be folded over, or any other means of closure may be used and located in the area shown as 50. A folded over flap material 90 is shown in FIG. 6.

With this understood, FIGS. 3 and 5 illustrate how, when the case 10 is placed in a rear trouser pocket 75 in the orientation shown, the case is comfortable, slender and does not bulge. The case fits into the pocket by being inserted with its top edge 28 or bottom edge 30 first, and with either the card side or the cash side facing outwardly. Due to the unique configuration of the two card pockets, size of cards and ability of the wallet to hinge at fabric 12 being the center, the wallet forms to the configuration of the buttocks whether standing, FIG. 3 or sitting, FIG. 5. The wallet is slender and comfortable.

In a preferred embodiment of the invention, the wallet construction is such that the depth of the sections allotted for the credit, business, and identification cards is selected substantially twice that depth than for the section in which the currency bills are to be kept. And, as will be understood, to get to the currency bills, the user just needs to reach into that section in pulling them out as needed. To get to the credit cards, business and identification cards, the user just needs to reach in and pull out all the cards together as a stack, and then flipping through them one by one as needed until the desired card is found. Obviously, those that are rarely used will be at the bottom of the stack or in one pocket rather than the other and be known to the wallet user.

While there has been described what is considered to be a preferred embodiment of the present invention, it will be readily apparent to those skilled in the art that modifications can be made without departing from the scope of the teachings herein. For at least such reason, therefore, resort should be had to the claims appended hereto for a true understanding of the scope of the invention.

I claim:

1. A wallet for retaining a plurality of credit and business identification cards along with currency bills, comprising:

a rectangularly configured case having a fabric partition insert having a center hinge portion running between side edges of the case in forming upper and lower sections of the case;

each of the upper and lower sections of the case adapted to receive via an opening of one of the side edges respective rectangularly shaped credit, business and identification cards oriented with their longer sides running parallel to top and bottom edges of the case and perpendicular to said side edges of the case, one behind the other, within the case in either of an upper section card pocket and a lower section card pocket formed via the center hinge portion of the fabric partition;

a fabric liner insert between said card pockets and an inside wall of the case in forming a section capable of receiving currency bills;

with the case sized and adapted for insertion into a back trouser pocket and adapted to hinge proximate the center hinge portion of the fabric insert without folding over.

2. The wallet of claim 1, wherein the case is of a leather or fabric outer composition on front and rear surfaces thereof.

3. The wallet of claim 2, further comprising a two component fastener system at said opening one of the side edges of the upper and lower sections of the case for securing the case closed.

4. The wallet of claim 3, wherein the two component fastener system includes a hook-and-loop adhesive.

5. The wallet of claim 3, wherein the two component system includes a zip-lock connection.

6. The wallet of claim 3, wherein the two component system includes a zipper construction.

7. The wallet of claim 3, wherein the two component system includes a flap of material which is affixed to the front surface of the case and folded over to secure the opening.

* * * * *